United States Patent [19]

Fleming

[11] 4,171,717

[45] Oct. 23, 1979

[54] COLOR-DIAL-HANDBAG

[76] Inventor: Charlie Fleming, 1511 Fulton St., Brooklyn, N.Y. 11216

[21] Appl. No.: 909,830

[22] Filed: May 26, 1978

Related U.S. Application Data

[63] Continuation-in-part of Ser. No. 335,048, Apr. 20, 1973, abandoned.

[51] Int. Cl.[2] ..... A45C 13/08

[52] U.S. Cl. ..... 150/28 A; 116/278; 116/317

[58] Field of Search ..... 150/28 P, 28 A; 354/217; 116/278, 284, 306, 309, 317

[56] References Cited

U.S. PATENT DOCUMENTS

| | | | |
|---|---|---|---|
| 981,064 | 1/1911 | Cole | 354/217 |
| 1,989,590 | 1/1935 | Florman | 150/28 R |
| 2,078,665 | 4/1937 | Horsley | 150/28 R |
| 3,010,425 | 11/1961 | Peavey | 116/278 |
| 3,575,226 | 4/1971 | Chapman | 150/28 R |

FOREIGN PATENT DOCUMENTS

| | | | |
|---|---|---|---|
| 111393 | 7/1964 | Czechoslovakia | 150/28 A |
| 1288466 | 5/1961 | France | 150/28 R |
| 209635 | 1/1924 | United Kingdom | 150/28 R |
| 686965 | 2/1953 | United Kingdom | 150/28 R |

*Primary Examiner*—Ro E. Hart

*Attorney, Agent, or Firm*—Friedman, Goodman & Teitelbaum

[57] ABSTRACT

A handbag whose exterior surface can be changed to display a selected color in order to match a particular ensemble. The handbag includes two opposed compartments which are hingedly connected to each other. Each compartment has a C-shaped sidewall with a top and bottom wall connected thereto. Spools are supported within each compartment adjacent the ends of the sidewall. A roll of material is threaded between the spools and passes around the exterior of the sidewall. By turning knobs connected to the spools, the material can be moved from one roll to the other roll passing around the exterior of the sidewall. The roll of material includes a sequence of colored sections, whereby a particular desired color section can be displayed on the exterior of the handbag.

10 Claims, 8 Drawing Figures

COLOR-DIAL-HANDBAG

RELATIONSHIP TO OTHER APPLICATION

This application is a continuation-in-part application of Ser. No. 335,048, now abandon filed on Apr. 20, 1973 for "Color-Dial-Handbag" by the same inventor. All the information contained in the aforereferenced application is herein incorporated by reference.

BACKGROUND OF THE INVENTION

This invention relates to handbags or pocketbooks, and more particularly to a handbag whose exterior can be changed.

A very important feature of style is to have a handbag or pocketbook, which is carried by a woman, match her particular ensemble. Such matching can be done by having the color of the handbag the same or close to particular colors of the clothes worn, or to have a particular design match the ensemble design. In order to achieve such coordination, it is frequently necessary for a woman to purchase and maintain a considerable number of handbags so that each can match a particular ensemble or wardrobe. However, this results in a very costly situation since fine quality handbags are quite expensive.

It would accordingly be desirable to have a handbag which can be modified so that the exterior color or design of the handbag is changeable, thereby to match the particular ensemble being worn. Additionally, it would be desirable to modify the exterior of the handbag so that the handbag itself might have a mixture of colors in order to make the handbag more interesting or attractive.

Various suggestions have been made for providing a handbag permitting ensemble matching. One solution is presented in U.S. Pat. No. 3,575,226 which includes panels which can be interfitted between a side and a holding frame portion of the handbag. The panels are selectively removed and replaced in order to match the particular ensemble. Another solution is provided in U.S. Pat. No. 2,809,685 which has removable exterior covers which can be selectively replaced to change a particular color or design of the handbag. Numerous other solutions have been proposed.

In most of the proposed solutions it is required to actually remove and replace a portion of the handbag. This necessitates the storage of extra panels or covers and requires considerable manipulation in order to modify the color or design of the handbag. Additionally, the color or design can be only changed at a location where the extra covers or panels are stored. As a result, once the handbag is in use, it cannot be changed at arbitrary times or locations.

SUMMARY OF THE INVENTION

It is therefore an object of the present invention to provide a handbag which avoids the aforementioned problems of prior art devices.

Another object of the present invention is to provide a handbag which permits easy changing of the exterior color or design of the handbag.

A further object of the present invention is to provide a handbag whose exterior color can be modified without the need for storing extra covers, panels, or other parts.

Yet a further object of the present invention is to provide a handbag which includes all of the desired colors or designs directly within the handbag itself.

A further object of the present invention is to provide a handbag which includes a roll of material threaded between two spools and passing around the exterior surface of the handbag, whereby the material can be rolled from spool to spool to selectively display various designs and colors on the outer surface of the handbag.

Briefly, the invention provides a design changeable handbag which includes dual-opposed compartments hingedly connected to each other. Each compartment comprises a C-shaped sidewall with a top and bottom wall connected thereto. Rotatable spools are supported within the compartment adjacent opposing ends thereof. A roll of material is threaded between the spools and passes around the exterior of the sidewall. The material contains a series of designs each of which can be selectively displayed on the exterior of the handbag by rotating the spools and causing the material to pass from one spool to the other spool around the outside of the handbag.

The invention further contemplates the use of top and bottom trays positioned over the top and bottom walls of each compartment. The trays can include an overhanging edge to form guideways along the edges of the top and bottom walls to thereby provide a track through which the material can pass from spool to spool. The top tray can include removable panels with each panel having a design matching a corresponding design displayed on the exterior of the sidewall.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENT

Figure 7:
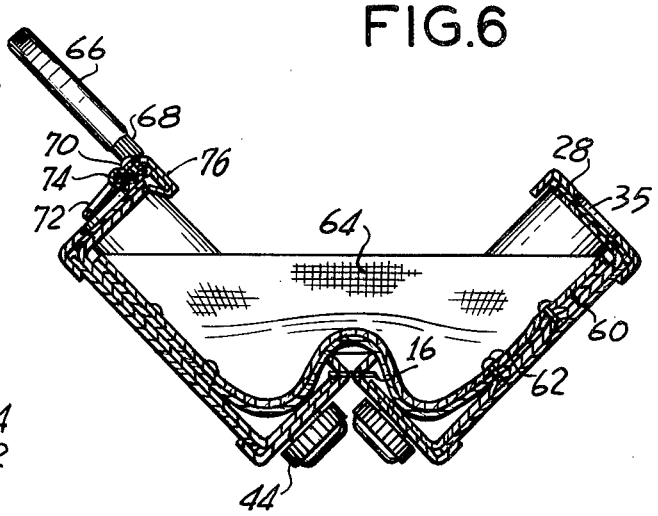
FIG. 7 is a cross sectional view of the open handbag taken along line 7—7 of FIG. 2.

Referring now to the drawings, the handbag of the present invention is shown generally at 10 and comprises first and second compartments 12, 14 of substantially identical design interconnected across their base portions by means of a hinge 16, as can best be seen in FIG. 7.

Figure 5:
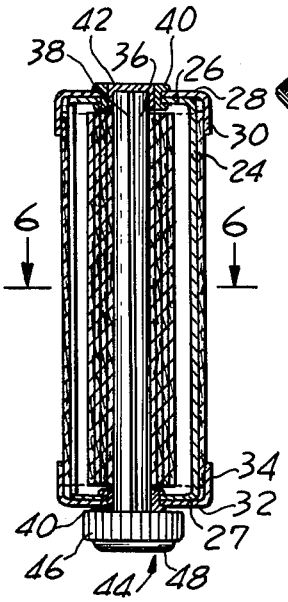
FIG. 5 is a side sectional view taken along line 5—5 of FIG. 1.

Each compartment comprises a C-shaped sidewall 18 which includes the opposing end sections 20 and 22 and the back section 24. The sidewall extends outwardly at the top thereof to provide a top wall 26, as well as extending outwardly at the bottom thereof to provide a bottom wall 27, as can best be seen in FIG. 5.

Overlying the top wall is an upper tray 28 having a depending lip 30 overhanging the sidewall. The size of the upper tray 28 is slightly larger than the top wall 26 so that a space is provided between the overhanging lip 30 and the back section 24 to define a passageway or track along the upper edge.

A bottom tray 32 covers the bottom wall 27 and also includes an overhanging lip 34 to also define a passageway or track therebetween along the bottom edge.

A portion of the top tray 28 is opened to display panels 35 which have been inserted between the top tray 28 and the top wall 26. The panels 35 can be strips formed of different colors or designs and the colors or designs can be matched to those of the exterior wall, as will hereinafter be explained.

Internally of the compartments, and adjacent the opposing ends of the compartments, are placed spools 36 with a slit 38 therein. The spools extend between the upper tray 28 and the lower tray 32 and pass through openings in the respective trays. The openings in the top and bottom trays each contain an eyelet or grommet 40. A cap 42 is placed at the upper end of each spool to prevent removal of the spool from between the trays.

A knob 44 is connected to the bottom end of each spool and extends outwardly from beneath the bottom tray 32. The knobs 44 include a knurled ring 46 with an extending boss 48. The knobs can thereby be utilized to turn the spools. At the same time, they can also be utilized as the legs for the handbag to support the handbag when placed down on a table or other supported surface.

Figure 1:
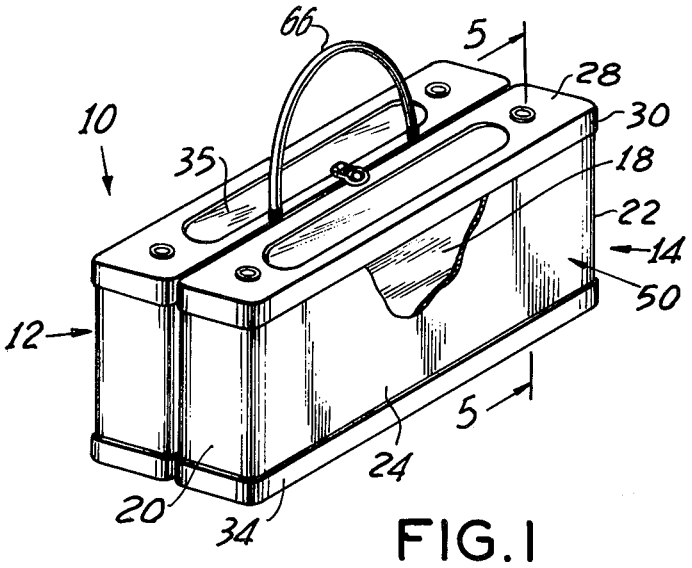
FIG. 1 is a perspective view, partially broken away, of the handbag in accordance with the present invention.
Figure 2:
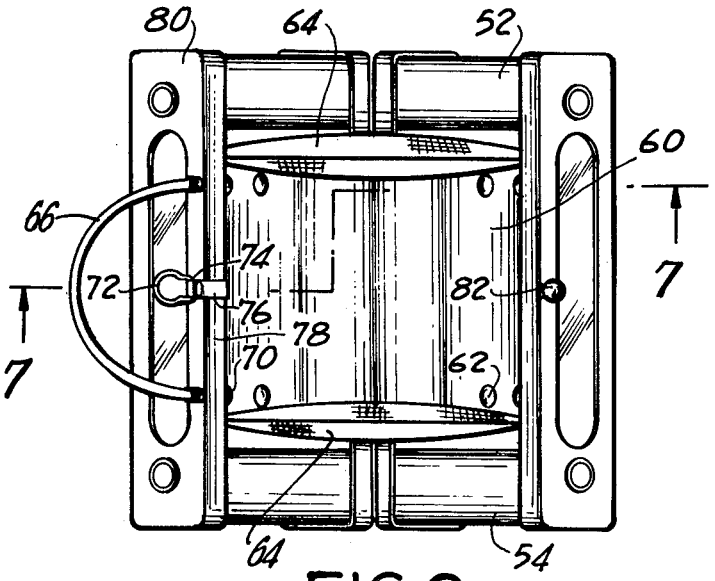
FIG. 2 is a top view showing the inside of the handbag.
Figure 3:
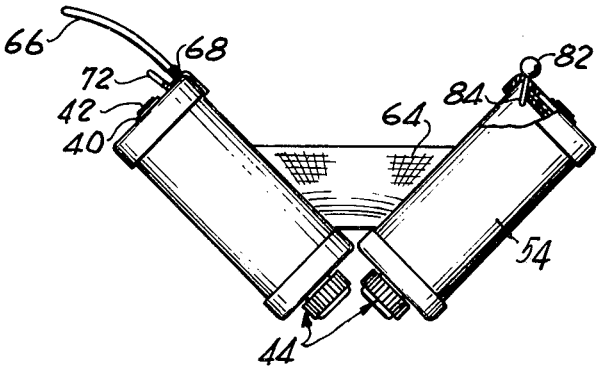
FIG. 3 is a side view of the open handbag.
Figure 4:
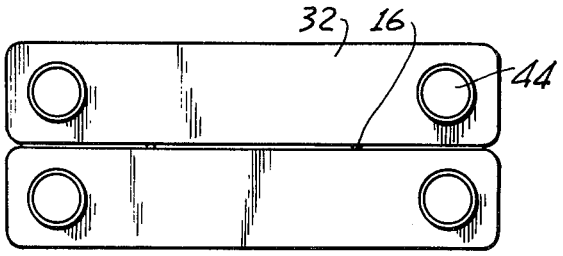
FIG. 4 is a bottom view of the handbag.
Figure 6:
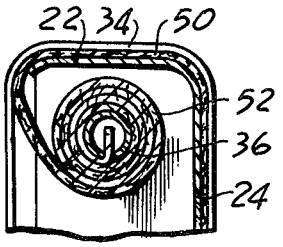
FIG. 6 is a cross sectional view of the spool taken along line 6—6 of FIG. 5.

A strip of material 50 is provided with its opposing ends being threaded into the spool slits at opposing ends of each compartment. Thus, the strip or material 50 utilized in connection with the compartment 14, has one edge thereof threaded around the spool at the end 52 and the other end threaded around the spool at the end 54, as shown in FIG. 2. The material extends around the exterior of the sidewall 18 and passes along the grooves or track formed between the top and bottom overhanging lips of the trays and the sidewall. By means of rotating the knobs of the spools, the material can be made to move from one spool to the other spool passing along the exterior of the sidewall.

The strip of material is formed with a sequence of colored sections. As can best be seen in FIG. 8, the section 56 of one color immediately follows section 58 of the next adjacent color. The length of each colored section is sufficient to extend entirely around the C-shaped sidewall 18 of each compartment. Additionally, the first and last sections are made slightly longer to permit threading into the slit of the spool. In this manner, the knobs can be rotated to position a single color around the complete sidewall of the compartment. By making both strips around each compartment identical in colors, both compartments can be adjusted to have the same color around the entire exterior whereby the entire pocketbook will be of a unitary color.

Figure 8:
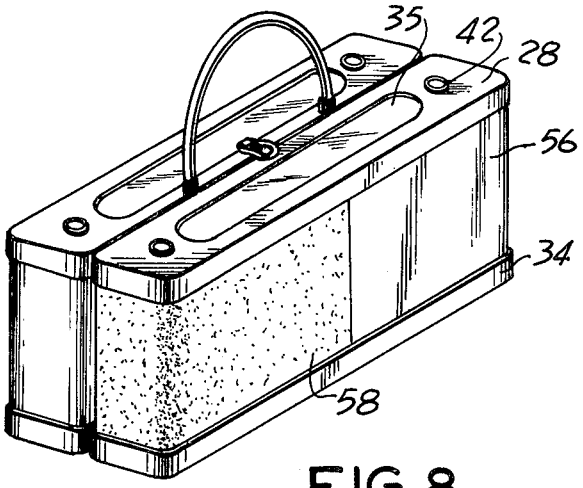
FIG. 8 is a perspective view showing the variations in the exterior color design of the handbag.

Alternately, the material can be adjusted as shown in FIG. 8, whereby two colors are mixed with one color being on one edge and the other color on the other edge. The opposing compartment could have a similar mixture of colors, or for that matter, a mixture of different colors. In this way, it will be apparent, that the particular color of the handbag can be easily modified to match or compliment a particular ensemble being worn. At the same time, the handbag itself can be easily adjusted to make the color such that the handbag itself will be attractive with a mixture of colors. It should be appreciated, that rather than colors, designs or other type of exteriors can be utilized on the strip material.

Internally of the handbag, a lining material 60 is connected by means of rivets 62 to the sidewalls, and spans across the two compartments. An elastic webbing 64 is connected by conventional means to the lining 60 and is also held by means of the rivets 62 to the sidewalls. The elastic webbing 64 spans across respective ends of the two compartments to form internal side portions for providing a storage pocket in conjunction with the lining 60 to permit storage of material in the handbag.

A handle 66 is connected to the top of the handbag. By way of example, the handle is shown as a vinyl soft strip held by the cups 68 which are riveted to the tray by rivets 70. The handle is positioned adjacent the facing edges of the upper trays so that when the handbag is closed, the handle will provide a balanced support for the handbag.

A clasp is provided which includes a ring 72 which passes through a loop portion 74 of a clip 76 extending around the lip 78 on the facing edge of the upper tray 80. A knob or an enlarged head 82 is placed on the edge of the opposing tray so that when the two compartments are brought together, the ring 72 can slip over the knob 82 and hold the handbag in a closed position. The knob 82 has a stem 84 which passes into the tray and is securely held in place.

The frame, including the sidewalls, top and bottom walls, and the trays, have been formed of aluminum. However, other materials such as magnesium and the like, can also be utilized. Similarly, plastic and other materials could be utilized. The material around the spools can be a vinyl color roll with each of the sections of the color being 12 ½ inches long (which is substantially the length of the C-shaped sidewall) except for the end sections which are 14 inches long to permit threading into the rolls, where each roll preferably has four different sections. Other types of material can be utilized such as cloth and leather, as well as two sided material. For the colors, spray-on vinyl and leather-spray colors could be utilized. The colors could also be two tones with a different color on half of each section. Also, one quarter of each section could be made a different color as well as different designs, stripes, etc. The number of colors on each roll can be varied depending upon the thickness of the material, the length of each color, the size of the handbag, and numerous other factors.

It is further noted, that the construction of the handbag of the present invention can be altered or modified without departing from the spirit of the present invention. For example, each compartment can be constructed with a thinner or wider cross section in the transverse direction, the opposing end sections can be even more rounded or less rounded for a desired configuration thereof, and the longitudinal length of the handbag can also be varied in the construction thereof as desired to obtain a particular appearance.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A design changeable handbag comprising dual opposed compartments hingedly connected to each other, each compartment including a C-shaped sidewall, top and bottom walls connected to each of said sidewalls, a pair of rotatable spools supported within each compartment adjacent opposing ends of the compartment, and a roll of material threaded between each pair of spools and passing around an exterior of its respective sidewall, each said material containing a series of designs each of which can be selectively displayed on an exterior of the handbag by rotating said spools.

2. A handbag as in claim 1 and further comprising top and bottom trays for each compartment being positioned over the top and bottom walls thereof, each of said trays having an overhanging lip for cooperation with said sidewalls to define edge guideways, said material passing through said edge guideways.

3. A handbag as in claim 2, wherein each said top tray is provided with an opening to display a removable panel, whereby the design of each panel can be matched to the design displayed on the exterior of the sidewalls.

4. A handbag as in claim 2, wherein said spools extend through said top and bottom trays, and further comprising knobs coupled to each lower end of said spools and located beneath the bottom trays, whereby said knobs simultaneously serve as legs of the handbag.

5. A handbag as in claim 2 and further comprising hinge means interconnecting adjacent facing edges of said bottom trays, and clasp means releasably interconnecting adjacent facing edges of said top trays.

6. A handbag as in claim 5 and further comprising handle means coupled to one of the top trays adjacent to said facing edge thereof.

7. A handbag as in claim 1 and further comprising lining material coupled to said sidewalls and spanning across an inside of said dual compartments.

8. A handbag as in claim 7 and further comprising elastic webbing material attached to opposite sides of said lining material, said webbing material being coupled to said sidewalls and spanning across respective ends of said compartments.

9. A handbag as in claim 1, wherein said series of designs comprises sequential sections of colors, the length of each color section being sufficient to entirely extend around the C-shaped sidewall of an associated compartment.

10. A handbag as in claim 9, wherein first and last color sections on each roll are each of greater length than the other color sections in order to accommodate the threading of their edges into the spools.

* * * * *